US012066270B2

(12) United States Patent
Wolfinbarger

(10) Patent No.: US 12,066,270 B2
(45) Date of Patent: Aug. 20, 2024

(54) TOY WATER GUN FOR RAPID FIRING OF INDIVIDUAL STREAM SEGMENTS OR BURSTS OF WATER

(71) Applicant: Ryan Wolfinbarger, Avon, IN (US)

(72) Inventor: Ryan Wolfinbarger, Avon, IN (US)

( * ) Notice: Subject to any disclaimer, the term of this patent is extended or adjusted under 35 U.S.C. 154(b) by 0 days.

(21) Appl. No.: 18/164,236

(22) Filed: Feb. 3, 2023

(65) Prior Publication Data

US 2023/0243617 A1 Aug. 3, 2023

Related U.S. Application Data

(60) Provisional application No. 63/306,189, filed on Feb. 3, 2022.

(51) Int. Cl.
*F41B 9/00* (2006.01)

(52) U.S. Cl.
CPC ..... *F41B 9/0075* (2013.01); *F41B 9/0018* (2013.01); *F41B 9/0071* (2013.01)

(58) Field of Classification Search
CPC ..... F41B 9/0071; F41B 9/0075; B05B 9/01
See application file for complete search history.

(56) References Cited

U.S. PATENT DOCUMENTS 3,512,543 A * 5/1970 Kubik ..... A01G 25/162 137/119.07
3,758,005 A * 9/1973 Christine ..... G01F 11/026 222/380
4,534,510 A * 8/1985 Rinkewich ..... B05B 3/0413 239/97
4,591,071 A * 5/1986 Johnson ..... F41B 9/0018 222/401
4,757,946 A * 7/1988 Johnson ..... F41B 9/0071 239/211
5,150,819 A * 9/1992 Johnson ..... F41B 9/0018 222/401
5,303,848 A * 4/1994 D'Andrade ..... F41B 9/0018 222/401
5,348,228 A * 9/1994 Wang ..... B05B 1/16 239/394
5,433,646 A * 7/1995 Tarng ..... F41B 11/57 239/289
5,662,244 A * 9/1997 Liu ..... F41B 9/0037 222/153.13

(Continued)

*Primary Examiner* — Bob Zadeh
*Assistant Examiner* — Randall A Gruby
(74) *Attorney, Agent, or Firm* — Volpe Koenig

(57) ABSTRACT

A toy water gun having a stream interrupter or interrupter valve that is configured to periodically interrupt a flow of water that is discharged such that periodic bursts of water are delivered in a rapid succession. In one arrangement, a nozzle recovery chamber is provided in a nozzle opening of the nozzle is located that is directed to discharge water through the nozzle recovery chamber along a discharge axis. The stream interrupter is located in the nozzle recovery chamber between the nozzle opening and the discharge opening and is configured to periodically interrupt a flow of water from the nozzle along the discharge axis to the discharge opening to form the periodic bursts of water that are delivered from the discharge opening. Blocked water in the recovery chamber is recycled back to the supply tank. Use of the interrupter valve provides for interrupted discharges from the nozzle.

11 Claims, 13 Drawing Sheets

(56) References Cited

U.S. PATENT DOCUMENTS

| | | | | |
|---|---|---|---|---|
| 5,799,827 | A | 9/1998 | D'Andrade | |
| 5,906,295 | A * | 5/1999 | D'Andrade | B05B 1/34 417/474 |
| 6,364,219 | B1 * | 4/2002 | Zimmerman | F41B 9/0012 239/394 |
| 6,474,507 | B1 * | 11/2002 | Hornsby | F41B 9/0028 222/113 |
| 6,631,830 | B2 * | 10/2003 | Ma | F41B 9/0071 251/75 |
| 6,935,531 | B1 * | 8/2005 | Clayton | F41B 9/0075 222/401 |
| 6,959,838 | B2 * | 11/2005 | Eddins | F41B 9/0018 446/159 |
| 11,892,266 | B1 * | 2/2024 | Zhang | F41B 9/0075 |
| 2019/0113301 | A1 * | 4/2019 | Ma | F41B 9/004 |

* cited by examiner

TOY WATER GUN FOR RAPID FIRING OF INDIVIDUAL STREAM SEGMENTS OR BURSTS OF WATER

CROSS-REFERENCE TO RELATED APPLICATIONS

This application claims the benefit of U.S. Provisional Application No. 63/306,189, filed Feb. 3, 2022, which is incorporated herein by reference as if fully set forth.

TECHNICAL FIELD

The present invention is directed to a toy water gun and more particularly, to a toy water gun that shoots a stream of water from a pressurized chamber.

BACKGROUND

Toy water guns are known which utilize pressurized air or an elastic bladder that can be charged with water as the motive force for discharging water from the gun upon release of a nozzle valve.

U.S. Pat. No. 5,799,827 discloses a water gun having a tubular bladder arranged in a tubular holding member as the motive force for water discharge. A separate water tank is located on the gun which holds water at ambient pressure. A pump located on the gun is utilized to transfer water from the ambient pressure water tank into the bladder, expanding the bladder. Upon release of a nozzle valve using a trigger, water is ejected from the toy gun in a continuous stream while the trigger is held.

Other similar water guns in this category use different types of pressure tanks or chambers in which water drawn from the storage tank is stored under pressure and then released in a stream when the trigger is pulled to actuate a release valve.

Other toy water guns are known utilizing a water tank with water at ambient pressure, and a pump having a handle that draws water from the tank with a stroke in a first direction, and delivers water in a steady stream through a nozzle as the pump is moved in the other direction, eliminating the need for a trigger.

In these as well as the other known prior art water guns, a steady stream of water is dispensed either based on a trigger being pulled or a pump handle being used to discharge water directly on the pressure/discharge stoke, with the water stream continuing as long as the trigger holds a discharge valve open and there is sufficient pressure, or the handle continues to move in the pressure/discharge stroke direction.

SUMMARY

It would be desirable to provide a different type of toy water gun that provides for the rapid firing of individual stream segments or bursts of water rather than a steady stream in order to have a different aesthetic to the water flow and provide for enhanced play activity. This is not possible in the prior art arrangements, but is accomplished with the various embodiments provided herein, which are considered exemplary.

A first embodiment provides a water gun having a housing along with a supply tank for water connected to the housing. A pump is provided that is configured to supply water from the supply tank under pressure to a nozzle. A nozzle recovery chamber is located on or formed with the housing into which at least a nozzle opening of the nozzle is directed or is located that is directed to discharge water through the nozzle recovery chamber along a discharge axis. A discharge opening is located in a wall of the nozzle recovery chamber aligned with the discharge axis through which the water is adapted to be discharged out from a discharge end of the water gun. A stream interrupter is located in the nozzle recovery chamber between the nozzle opening and the discharge opening and is configured to periodically interrupt a flow of water from the nozzle along the discharge axis to the discharge opening such that periodic bursts of water are adapted to be delivered from the discharge opening. This a series of individual stream segments or bursts, which can be referred to as water balls, to be discharged in rapid succession, with the blocked water flow that is interrupted by the stream interrupter being captured in the nozzle recovery chamber In a preferred arrangement, a check valve is located in a fluid path between the nozzle recovery chamber and the supply tank in order to allow the blocked water that is collected by the nozzle recovery chamber to be recycled back to the supply tank. The fluid path can be a tube or a direct connection. Here, the supply tank has a refill cap that seals a refill opening of the supply tank such the pump drawing water from the supply tank is adapted to draw any water captured in the nozzle recovery chamber back into the supply tank.

In one preferred arrangement, the pump is a manually actuatable pump having a handle connected to a piston, and movement of the pump handle in a charging direction is adapted to draw water from the supply tank into a pump chamber, and movement of the pump handle in an opposite, discharge direction forces the water to the nozzle. This allows for continued use of the toy water gun without batteries, and also eliminates the need for electrical components which can be more prone to damage or decay in a wet environment. However, it is also possible to provide a battery powered pump.

In one embodiment, the stream interrupter comprises a helical vane rotatably mounted on an axis parallel to the discharge axis such that a portion of the helical vane intersects the discharge axis. The helical vane includes at least one discharge gap through which a portion of the flow of water from the nozzle along the discharge axis to the discharge opening can pass such that the periodic bursts of water are adapted to be delivered from the discharge opening. Here, the helical vane is adapted to be rotated by the flow of water from the nozzle along the discharge axis to the discharge opening, and there is sufficient spray at the edges of the water flow from the nozzle to maintain movement of the helical vane when the at least one discharge gap is aligned with the discharge axis.

In another embodiment, the stream interrupter comprises a blocking plate that is mounted for pivoting or sliding movement and is configured to periodically pivot or slide into a blocking position to block the flow of water from the nozzle along the discharge axis to the discharge opening to periodically interrupt the flow of water such that the periodic bursts of water are adapted to be delivered from the discharge opening. Various different linkages can be used to move the blocking plate.

For the arrangement with the manually actuatable pump the blocking plate can also be activated by the movement of the pump handle. Here, a toothed rack having teeth can be connected to or formed with the pump handle. A follower is engaged with the toothed rack and is configured to move up and down as the teeth move past the follower. Here, the follower is constrained for either linear or rotary movement. A linkage is connected between the follower and the blocking plate to pivot or slide the blocking plate into and out of the blocking position as the pump handle is moved in the discharge direction.

In a preferred arrangement, a cone-shaped water baffle is located in the nozzle recovery chamber around the discharge opening. This prevents at least some of the blocked water in the nozzle recovery chamber from leaking out the discharge opening if the discharge opening is oriented downwardly.

In another embodiment, water gun is provided having a housing and a supply tank connected to the housing. A pump is provided that is configured to supply water from the supply tank under pressure to a nozzle. In this embodiment, an interrupter valve is connected in a flow path to the nozzle and is configured to periodically open and close in order to interrupt a flow of water to the nozzle such that periodic bursts of water are adapted to be delivered from the nozzle.

In one preferred arrangement, an expansion tank is provided in fluid communication with the flow path between the pump and the interrupter valve and is configured to buffer a supply of pressurized water from the pump when the interrupter valve is closed.

In one preferred arrangement, the interrupter valve is configured to open and close as the pump is actuated.

In one preferred arrangement, the pump is a manually actuatable pump having a handle connected to a piston. Movement of the pump handle in a charging direction is adapted to draw water from the supply tank into a pump chamber, and movement of the pump handle in an opposite, discharge direction forces the water to the nozzle.

In order to provide rapid, automatic actuation of the interrupter valve, a toothed rack having teeth is connected to or formed with the pump handle. A follower is engaged with the toothed rack and is configured to move up and down as the teeth move past the follower. The follower is connected to the interrupter valve and is configured to periodically open and close the interrupter valve as the pump handle is moved in the discharge direction. This is done automatically as the pump handle is moved.

In one arrangement, the expansion tank comprises a movable or flexible wall located on the piston. Alternatively, the expansion tank comprises a chamber connected to the housing with a moveable or flexible wall located in the chamber.

In another preferred arrangement, a toothed rack having teeth is connected to a movable handle, a follower is engaged with the toothed rack that is configured to move up and down as the teeth move past the follower. The follower is connected to the interrupter valve and is configured to periodically open and close the interrupter valve as the movable handle is moved. This can be used in conjunction with a separate pump to pressurize the water tank and a separate trigger to release the pressurized water from the tank toward the nozzle in order to deliver periodic bursts of water from the discharge opening.

A further arrangement uses a pump to pressurize the supply tank with air, and a further control for the interrupter valve is provided.

A method of operating a water gun is also provided. The method includes providing a toy water gun according to one of the embodiments disclosed herein, and a user placing water in the supply tank. The user then actuates the pump, and the stream interrupter periodically interrupts a flow of water from the nozzle along the discharge axis to the discharge opening as the pump is actuated such that periodic bursts of water are delivered from the discharge opening. Alternatively, the interrupter valve can be periodically actuated to periodically interrupt a flow of water from the nozzle.

For the manually actuatable pump, the method can further include the user moving the pump handle in a charging direction to draw water from the supply tank into a pump chamber, and the user then moving the pump handle in an opposite, discharge direction forcing the water to the nozzle with the movement of the pump handle simultaneously causing the follower to move up and down as the teeth on the rack move past the follower, pivoting or sliding the blocking plate into and out of a blocking position to periodically interrupt a flow of water from the nozzle along the discharge axis to the discharge opening.

It is noted that various ones of the above-noted features can be used alone or in combination with one another.

BRIEF DESCRIPTION OF THE DRAWINGS

The foregoing summary, as well as the following detailed description will be better understood when read in conjunction with the appended drawings, which illustrate a preferred embodiment of the invention. In the drawings.

DETAILED DESCRIPTION

Figure 1:
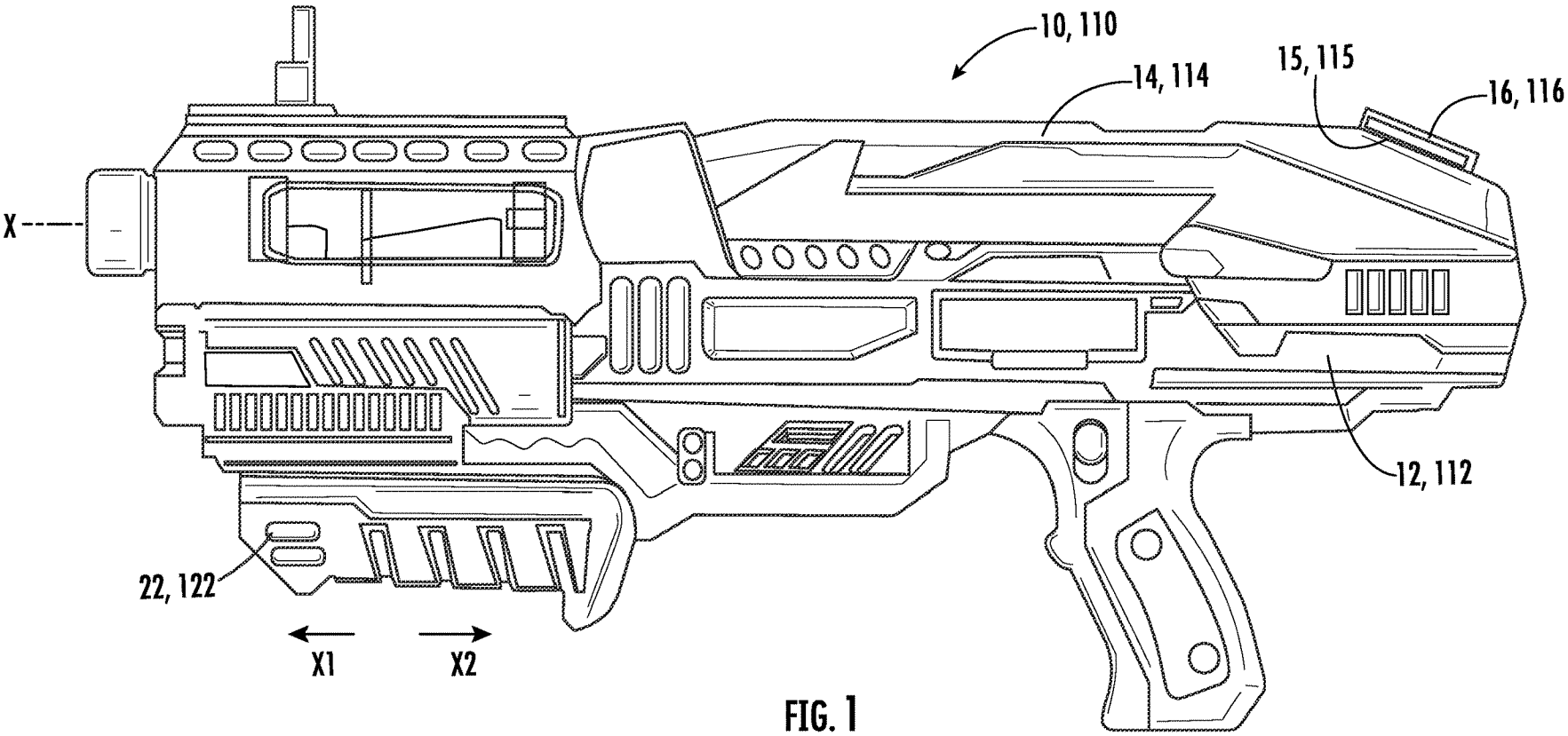
FIG. 1 is a left side elevational view of a toy water gun in accordance with a preferred embodiment. The right side elevational view is a mirror image thereof.

Certain terminology is used in the following description for convenience only and is not limiting. The words "inwardly" and "outwardly" refer to directions toward and away from the parts referenced in the drawings. A reference to a list of items that are cited as, for example, "at least one of a or b" (where a and b represent the items being listed) means any single one of the items a or b, or a combination of a and b thereof. This would also apply to lists of three or more items in like manner so that individual ones of the items or combinations thereof are included. The terms "about" and "approximately" encompass + or −10% of an indicated value unless otherwise noted. The term "generally" in connection with a radial direction encompasses +/−25 degrees. The term "tube" encompasses any fluid conducting conduit, which can be formed from one or more parts or segments, and can be flexible or rigid. The terminology includes the words specifically noted above, derivatives thereof and words of similar import.

Figure 2:
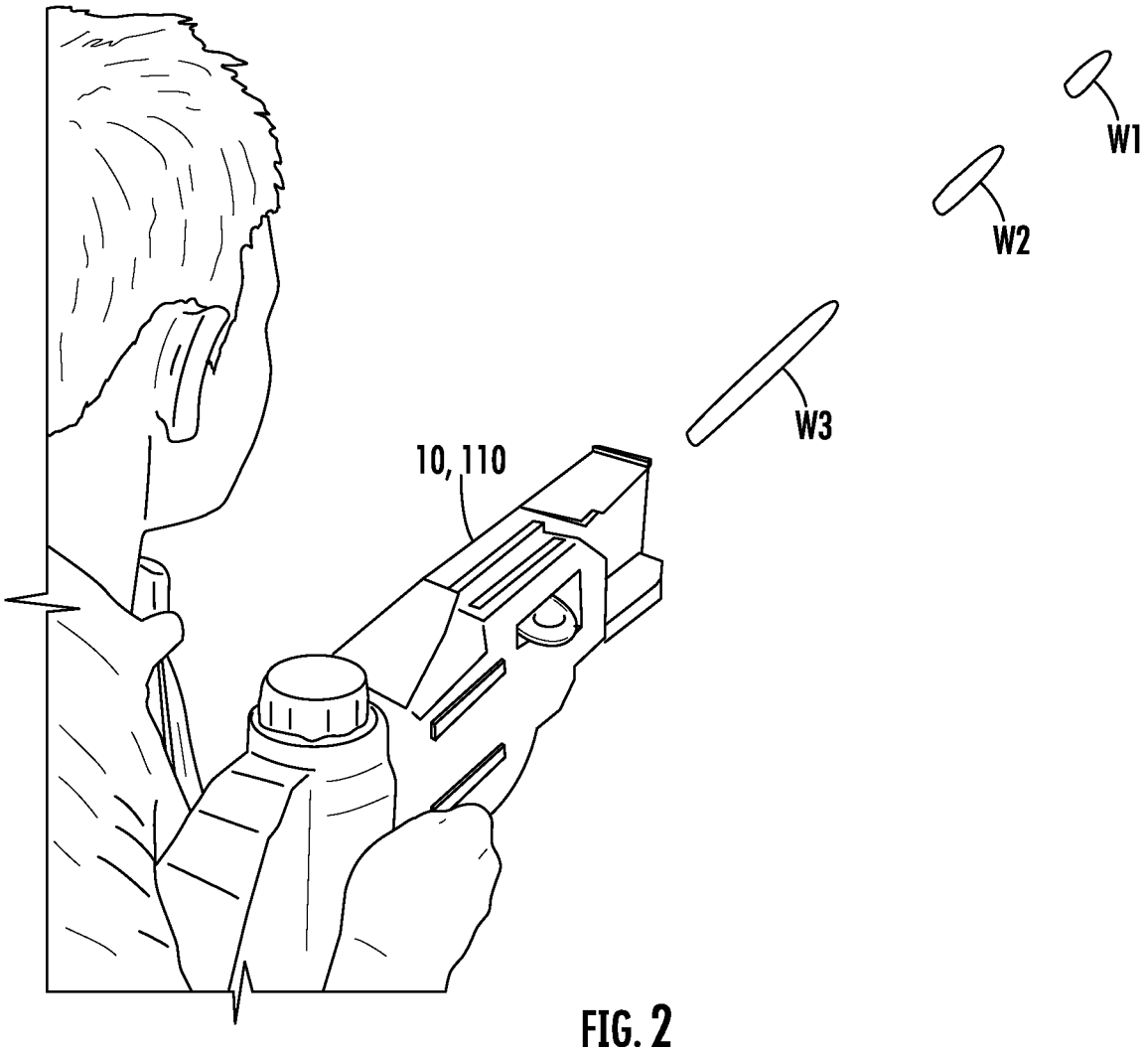
FIG. 2 is a perspective view showing the toy water gun of FIG. 1 in use.
Figure 3:
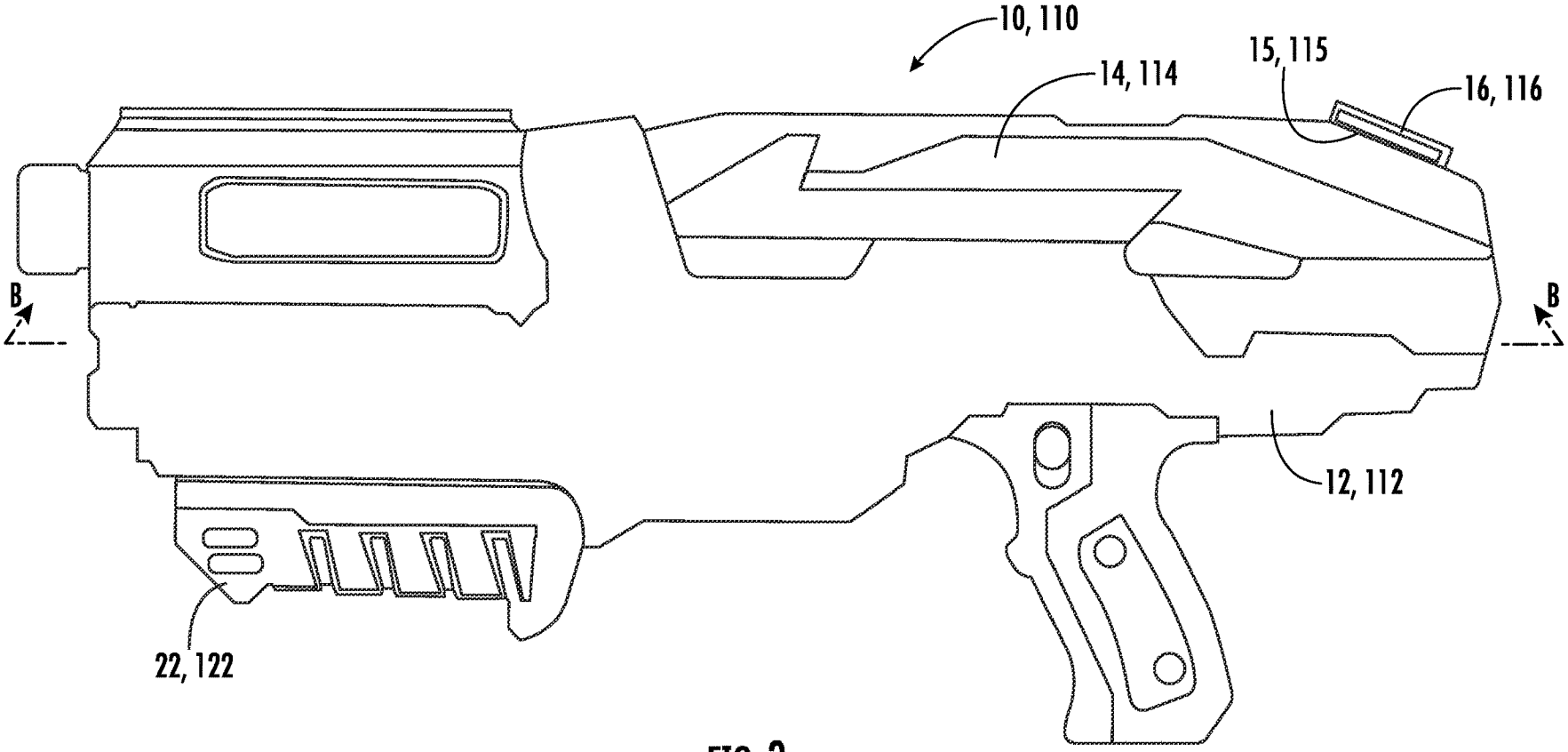
FIG. 3 is a schematic left side view showing the toy water gun of FIG. 1.

Referring now to FIGS. 1-3, a water gun 10, 110 according to the present invention is shown. The water gun 10, 110 has a housing, 12, 112 as well as a supply tank 14, 114 connected to the housing 12, 112. The supply tank 14, 114 has a refill opening 15, 115 as well as a cap 16, 116. Water W is located in the supply tank 14, 114 during use.

As shown in FIG. 2, the toy water gun 10, 110 is configured to discharge periodic bursts of water W1, W2, W3 from the discharge end. These bursts of water W1-W3 can also be referred to as water segments or water balls and are adapted to be discharged in rapid succession as a user activates the toy water gun 10.

Figure 4:
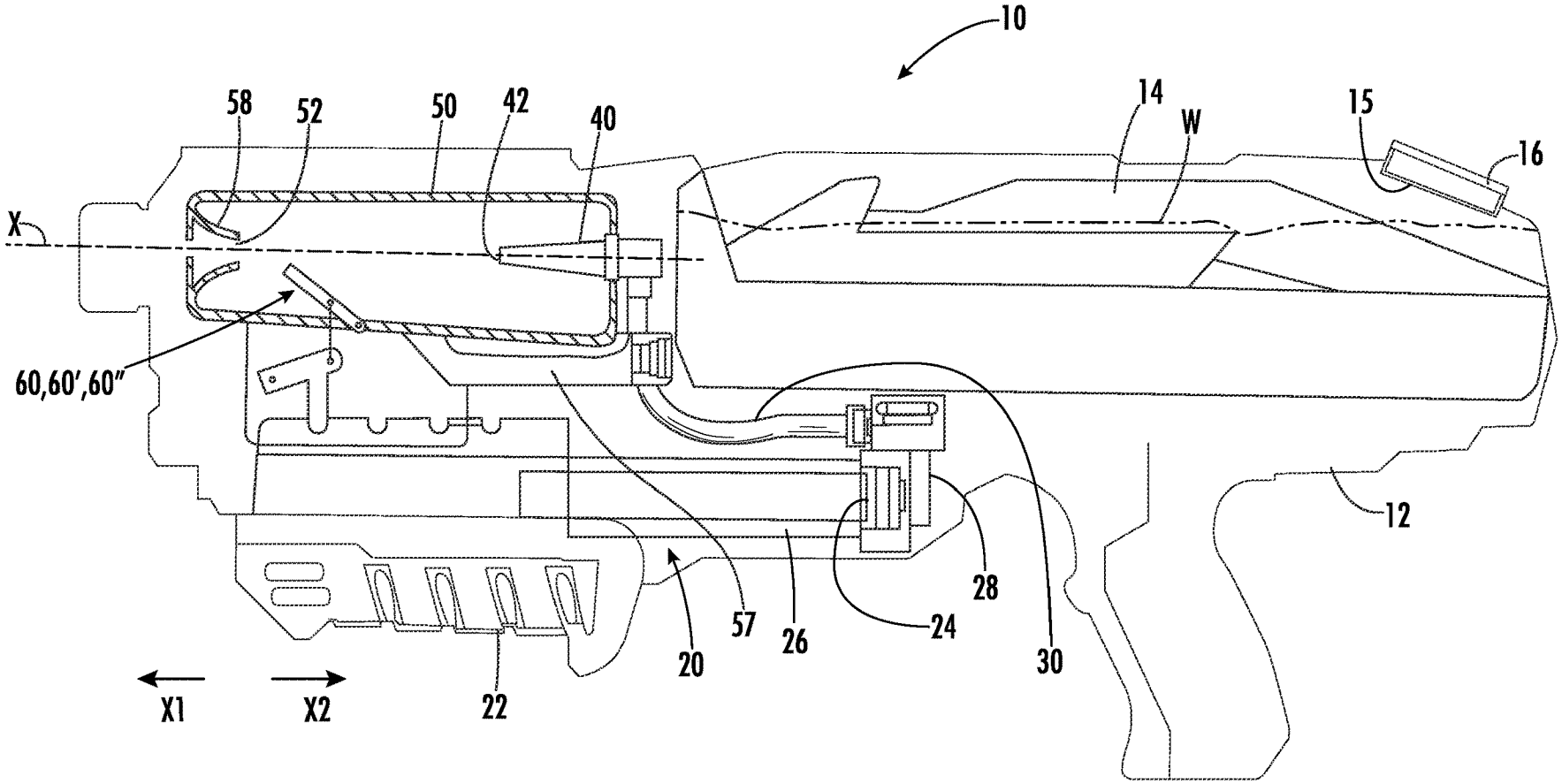
FIG. 4 is a schematic elevational view similar to FIG. 3 in which the internal functional components of the toy water gun are represented.
Figure 5:
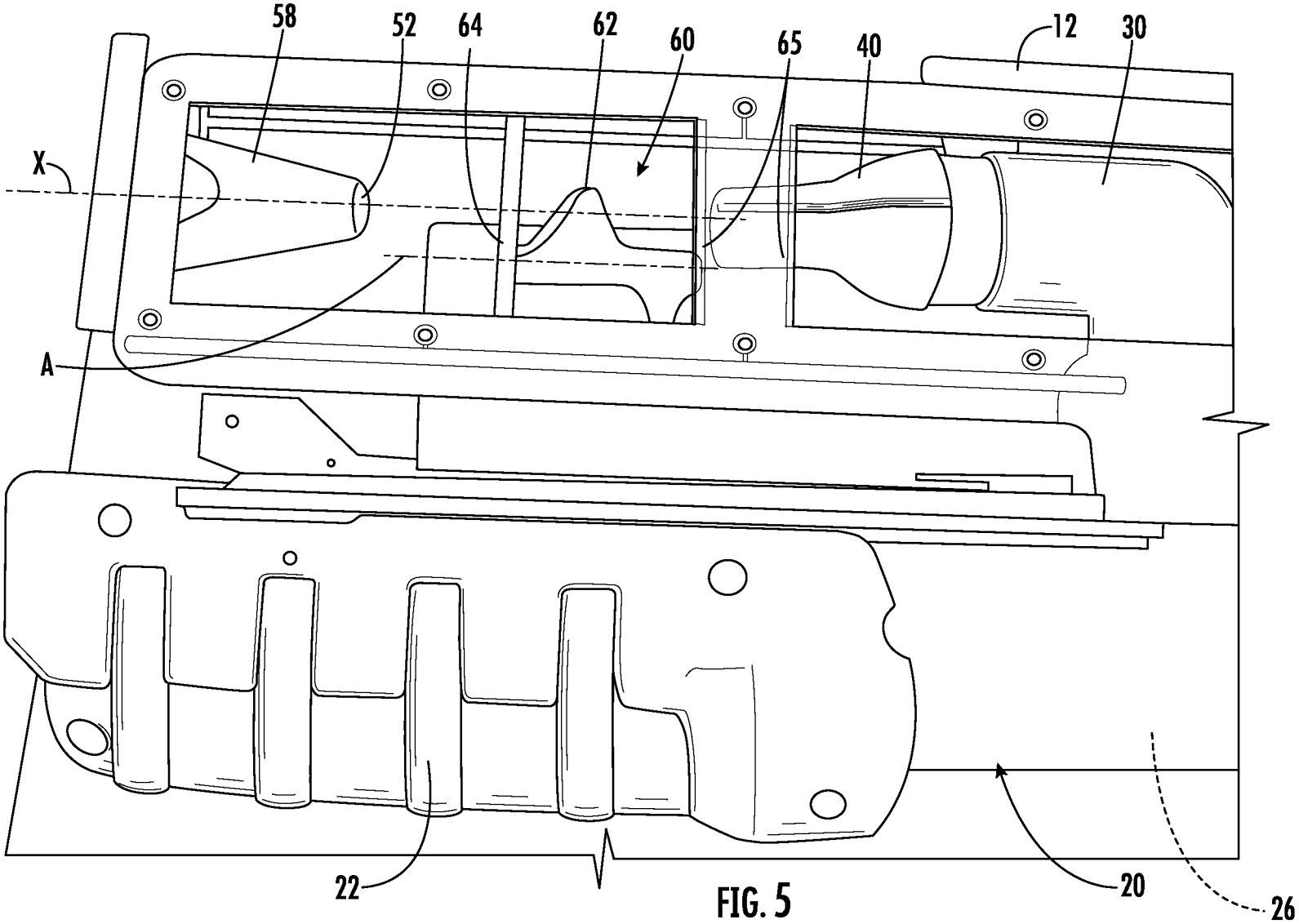
FIG. 5 is a detailed view of a first embodiment of a stream interrupter used in the toy water gun shown in FIGS. 1-3.
Figure 6:
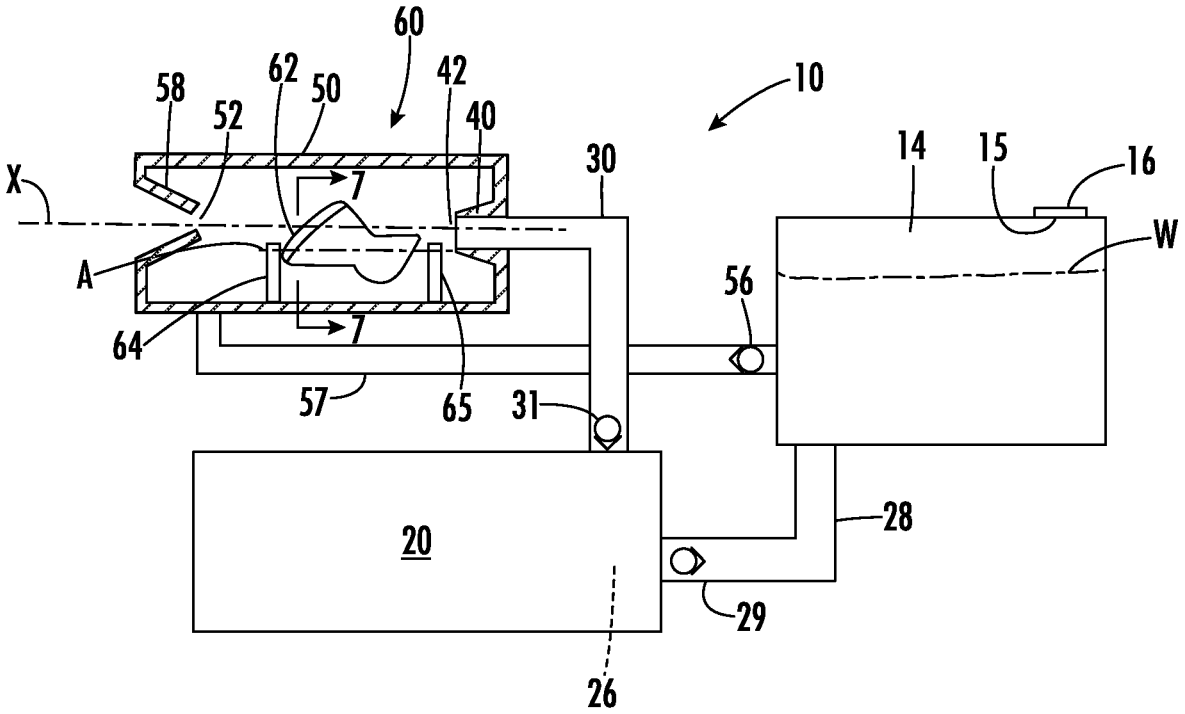
FIG. 6 is a functional diagram showing the arrangement of the functional components of the water gun in FIG. 5.
Figure 7:
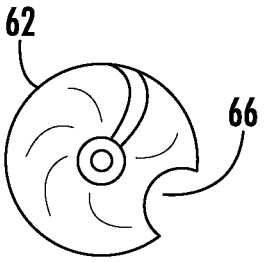
FIG. 7 is a view taken along line 7-7 in FIG. 6 showing the helical vane stream interrupter.

Referring to FIGS. 5-7, as well as in part to FIG. 4 in connection with the pump, a first embodiment of the toy water gun 10 includes the pump 20 for drawing water W from the supply tank 14 and forcing the water W to a nozzle 40. A nozzle recovery chamber 50 in which at least a nozzle opening of the 42 nozzle 40 is located or is directed so that water is discharged through the nozzle recovery chamber 50 along a discharge axis X is shown. A discharge opening 52 is located in a wall 54 of the nozzle recovery chamber 50 aligned with the discharge axis X through which the water W is adapted to be discharged. A stream interrupter 60 is located in the nozzle recovery chamber 50 between the nozzle opening 42 and the discharge opening 52 and is configured to periodically interrupt a flow of water W from the nozzle 40 along the discharge axis X to the discharge opening 52 such that periodic bursts of water W1, W2, W3 are adapted to be delivered from the discharge opening 52.

As shown in FIGS. 4 and 6, a recovery tube 57 is connected between the nozzle recovery chamber 50 and the supply tank 14. A recovery check valve 56 is located in the tube 57 or at the connection between the recovery tube 57 and either the nozzle recovery chamber 50 or the supply tank 14. The supply tank 14 has a refill cap 16 that seals the refill opening 15 of the supply tank 14. By providing the sealed refill opening 15, when the pump 20 draws water from the supply tank 14, it will also draw water captured in the nozzle recovery chamber 50 back into the supply tank 14.

As shown particularly in FIGS. 1, 4, and 5 in connection with the first embodiment and also explained in further detail below in connection with the additional embodiments, the pump 20 is preferably a manually actuatable pump having a handle 22 connected to a piston 24. Movement of the pump handle 22 in a charging direction X1 is adapted to draw water W from the supply tank 14 into a pump chamber 26, and movement of the pump handle 22 in a opposite, discharge direction X2, forces the water W to the nozzle under pressure (i.e., at greater than atmospheric pressure so that a stream of water can be discharged). As shown in FIGS. 4 and 6, a first tube 28 is connected between the supply tank 14 and the pump chamber 26, and a first check valve 29 is located in the first tube 28 or the connection between the first tube 28 and the pump chamber 26. A second tube 30 is connected between the pump chamber 26 and the nozzle 40, and a second check valve 31 is located in the second tube 30 or at the connection between the pump chamber 26 and the second tube 30. The first check valve 29 allows water W to be drawn from the supply tank 14 into the pump chamber 26 as the pump handle 22 moves the piston 24 in the charging direction X1. During this movement of the pump handle 22 in the charging direction X1, the second check valve 31 is closed. When the pump handle 22 along with the piston 24 are moved in the discharge direction X2, the first check valve 29 closes and the second check valve 31 opens such that the discharge movement of the pump handle 22 results in water W in the pump chamber 26 being forced by the piston 24 through the second tube 30 and out the nozzle 40.

In the first embodiment of the toy water gun 10, the stream interrupter 60 comprises a helical vane 62, shown in detail in FIGS. 5-7, that is rotatably mounted on an axis A parallel to the discharge axis X, preferably via support 64 and 65, such that a portion of the helical vane 62 intersects the discharge axis X. The helical vane 62 includes a discharge gap 66 through which a portion of the flow of water W from the nozzle 40 along the discharge axis X to the discharge opening 52 can pass such that the periodic bursts of water W1, W2, W3 (as shown in FIG. 2) are adapted to be delivered from the discharge opening 52. While the preferred embodiment of the helical vane 62 includes only a single discharge gap 66, it is possible that two or more discharge gaps 66 could be provided, depending upon the desired interruption between the periodic bursts of water W1, W2, W3.

The helical vane 62 is adapted to be rotated by the flow of water W from the nozzle 40 along the discharge axis X to the discharge opening 52. Water deflected by the helical vane 62 into the nozzle recovery chamber 50 can then be recycled by being drawn back into the supply tank 14 during the movement of the pump handle 22 in the charging direction X1 by the water being drawn through the recovery tube 57 and the recovery check valve 56 which opens when the pump handle is moved in the charging direction X1.

As shown in detail in FIGS. 4, 5, and 6, a cone-shaped water baffle 58 is preferably located in the nozzle recovery chamber 50 around the discharge opening 52. This prevents most of the water W captured in the nozzle recovery chamber 50 from leaking out of the nozzle recovery chamber 50 through the discharge opening 52 if the toy water gun 10 is pointed down.

Figure 9:
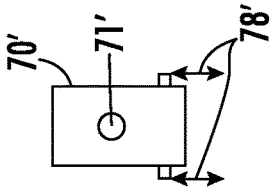
FIG. 9 is a view of the stream interrupter in the form of a sliding plate, taken along lines 9-9 in FIG. 8.
Figure 8:
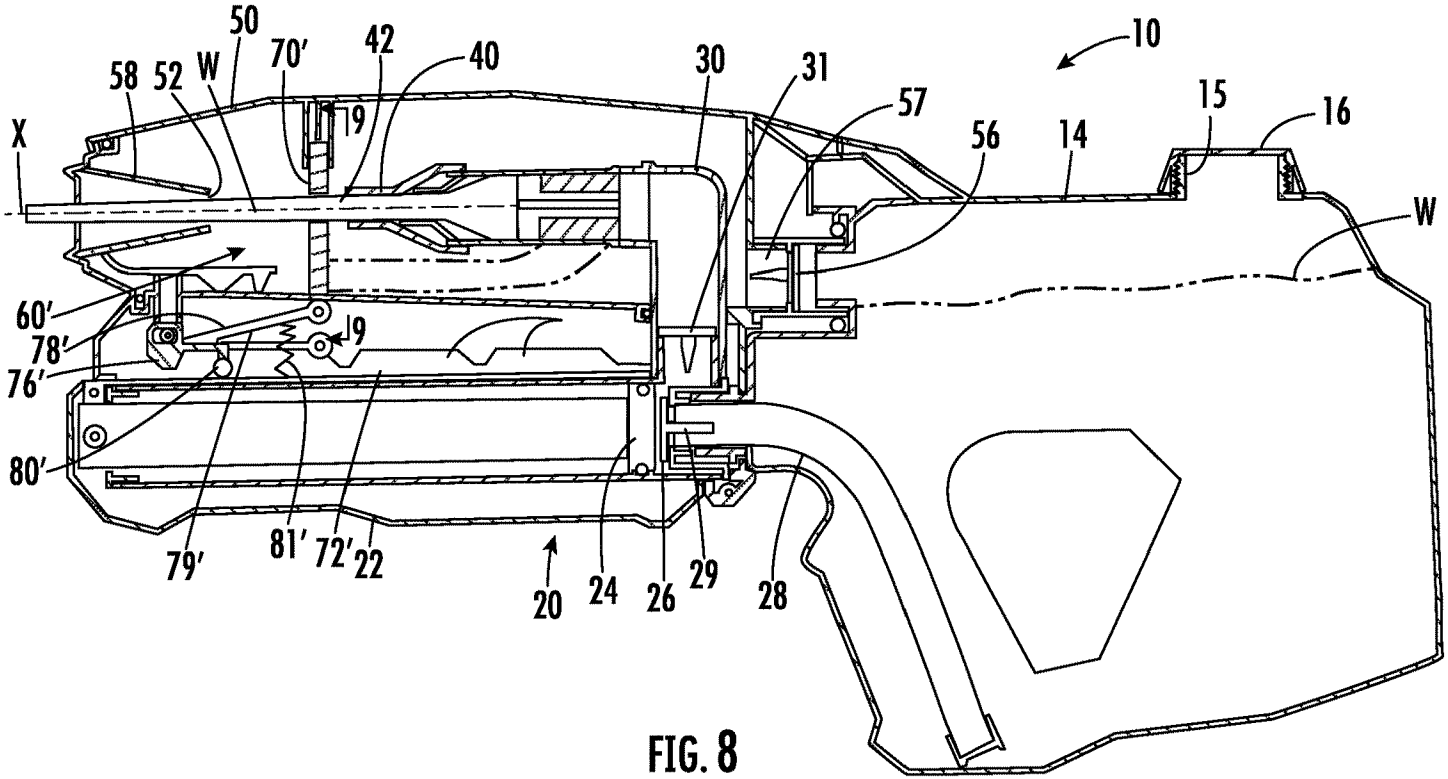
FIG. 8 is a left side schematic view taken along line B-B in FIG. 3 showing the internal functional components of a second embodiment of the water gun shown in FIGS. 1-3.

Referring now to FIGS. 8 and 9, a second embodiment of the toy water gun 10 is shown. The second embodiment is similar to the first embodiment and like elements are identified with the same reference numerals. In the second embodiment, the toy water gun 10 includes the stream interrupter 60' formed as a blocking plate 70' that is mounted for sliding movement. The blocking plate 70' is configured to periodically move into a blocking position to block the flow of water W from the nozzle 40 along the discharge axis X to the discharge opening 52 in order to periodically interrupt the flow of water W such that periodic bursts of the water W1, W2, W3 are adapted to be delivered from the discharge opening 52. As shown in FIG. 9, the blocking plate 70' includes a hole 71' that is adapted to move into and out of alignment with the discharge axis X.

In a preferred arrangement, in which the pump 20 is a manually actuatable pump having a handle 22 connected to a piston 24, a toothed rack 72' having teeth 74' is connected to the pump handle 22 and a follower 76' is engaged with the toothed rack 72' and is configured to move up and down as the teeth 74' move past the follower 76'. A linkage 78' is connected between the follower 76' and the blocking plate 70' to slide the blocking plate 70' into and out of the blocking position as the pump handle 22 is moved in the discharge direction X2. In the embodiment shown in FIG. 8, the linkage 78' includes an arm 79' that is integrally formed with or connected to the follower 76', and the follower 76'/arm 79' include a pivot 80' such that movement of the follower 76' up and down as it contacts the teeth 74' of the toothed rack 72' results in the end of the arm 79' which is pivotally engaged with a bottom of the blocking plate 70' pulling the blocking plate 70' up and/or down. A spring 81' is provided that can bias the blocking plate 70' to either a blocking or unblocked position, depending upon the location of the hole 71'. The embodiment of the linkage 78' shown is only exemplary, and those skilled in the art will recognize that other types of linkages can be used in order to provide the sliding movement for the blocking plate 70'.

Figure 10:
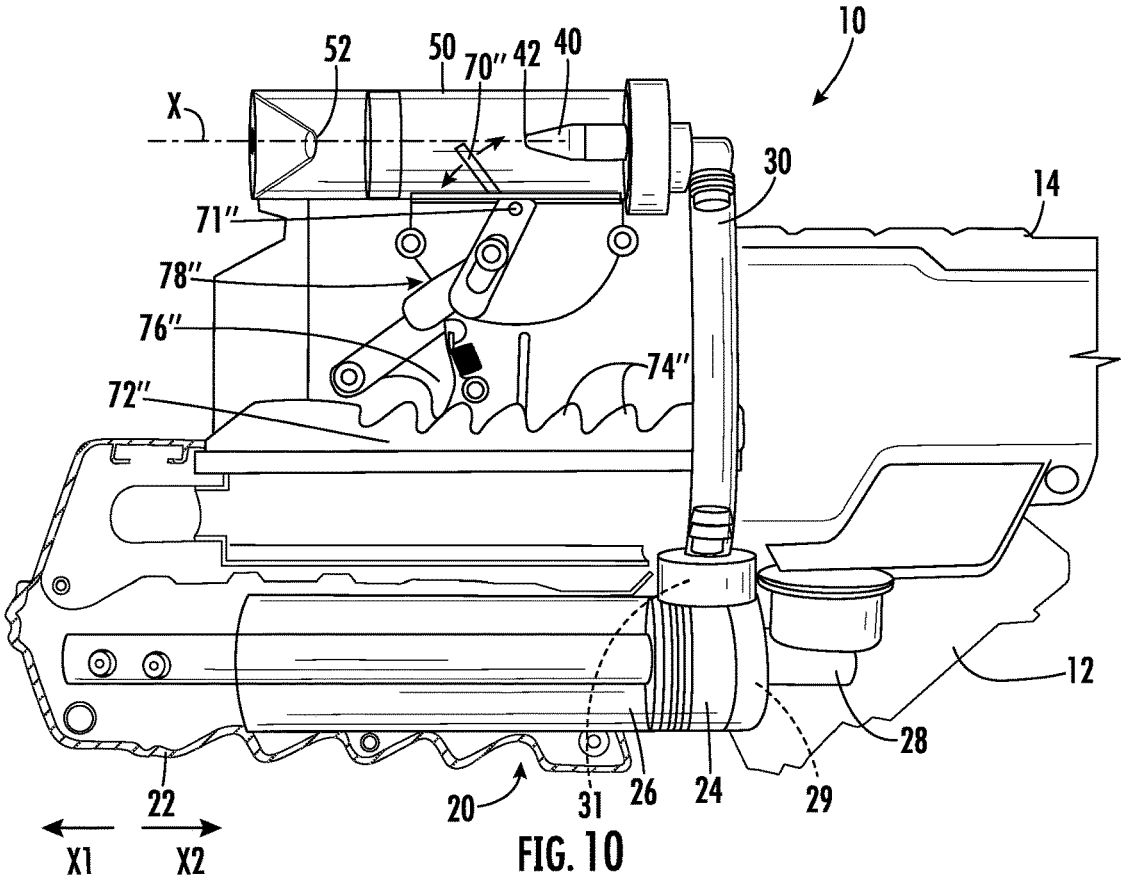
FIG. 10 is a left side view, partially in cross-section taken along line B-B in FIG. 3, showing the internal functional components of a third embodiment of a stream interrupter for the water gun shown in FIGS. 1-3.
Figure 11:
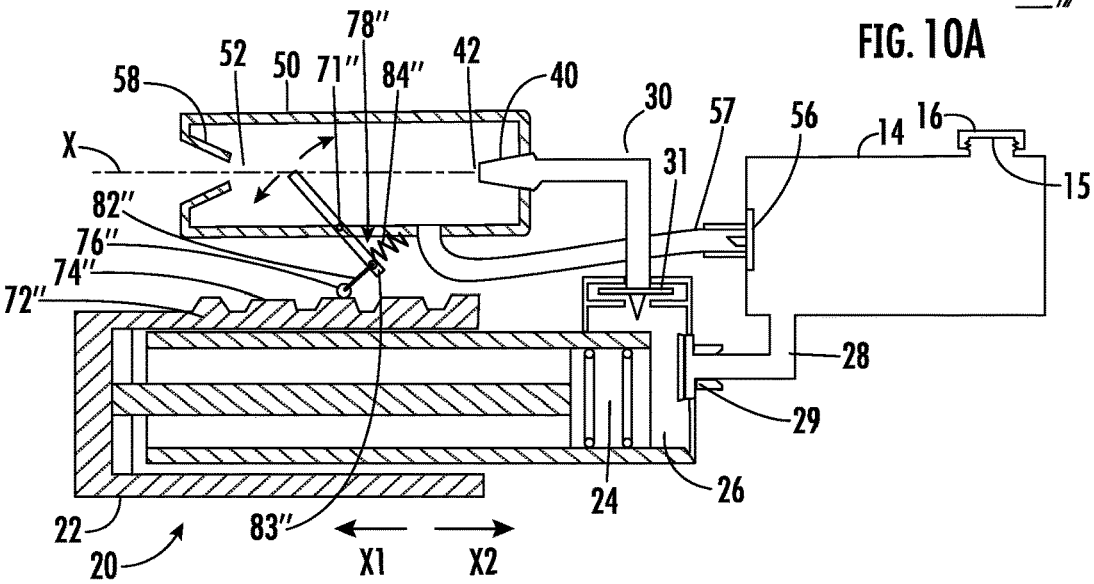
FIG. 11 is a functional diagram showing the arrangement of the functional components of the water gun in FIG. 10.
Figure 12:
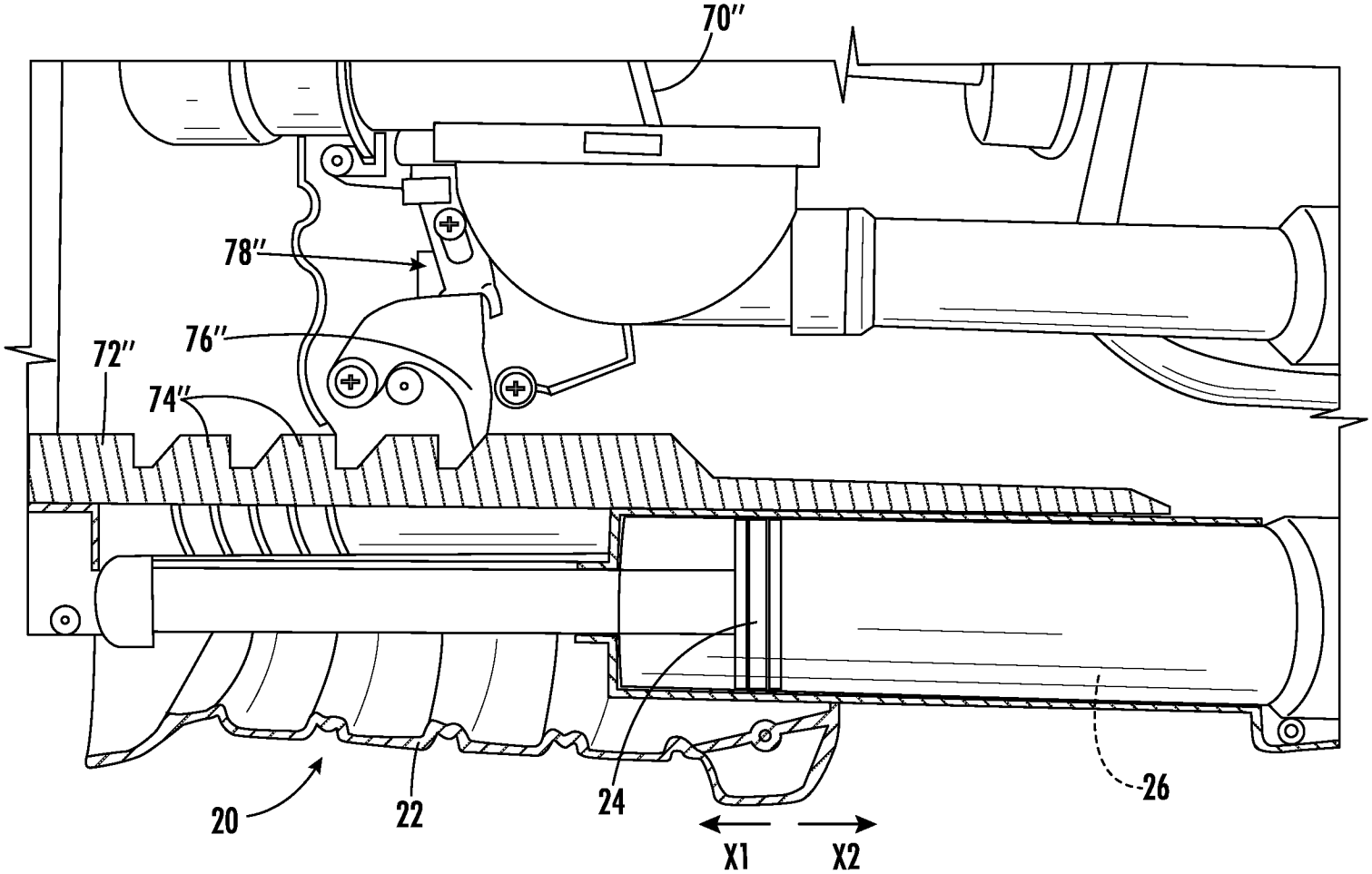
FIG. 12 is a view similar to FIG. 10 of the third embodiment of the water gun showing the pump handle with the pump in the charged position.

Referring to FIGS. 10-12, as well as the exemplary stream interrupter 60' shown in FIG. 4, in a third embodiment of the toy water gun 10, the blocking plate 70" is mounted for pivoting movement about a pivot 71" and is configured to periodically move into a blocking position to block the flow of water W from the nozzle 40 along the discharge axis X to the discharge opening 52 in order periodically interrupt the flow of water W such that the periodic bursts of water W1, W2, W3 are adapted to be delivered form the discharge opening 52.

In this case, a toothed rack 72" having teeth 74" is connected to the pump handle 22, and a follower 76" is engaged with the toothed rack 72" and is configured to move up and down as the teeth 74" move past the follower 76". Here, a linkage 78", schematically shown in FIG. 11, is connected between the follower 76" and the blocking plate 70" in order to pivot the blocking plate 70" into and out of the blocking position as the pump handle 22 is moved in the discharge direction X2.

One exemplary embodiment of the linkage 78" is shown schematically in FIG. 11. Here the linkage 78" includes an arm 82" connected to the follower 76". The arm 82" is connected with the blocking plate 70" which is mounted for movement about a pivot 71" such that as the follower 76" moves up and down along the teeth 74", the blocking plate 70" is pivoted into an out of the blocking position to block the flow of water W form the nozzle 40 along the discharge axis X to the discharge opening 52. Preferably, the arm 82" is pivotally connected to the blocking plate 70" via a pivot 83" and a spring 84" can bias the blocking plate 80" into either a blocking position or an unblocked position, depending upon the particular linkage arrangement.

Figure 10A:
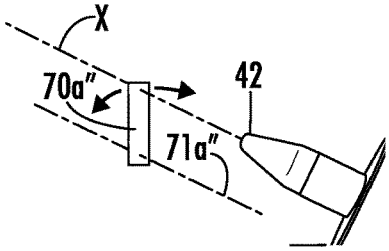
FIG. 10A is a schematic view of an alternate arrangement of the blocking plate shown in FIG. 10

FIG. 10 shows a preferred embodiment of the linkage 78" connected between the follower 76" and the blocking plate 70". Those skilled in the art will recognize from the present disclosure that the form of the linkage 78" can vary in order to provide the desired pivoting movement of the blocking plate 70". Further, the pivoting movement of the blocking plate 70" is not limited to a direction normal to the discharge axis X. The pivoting movement can be about the pivot 71" as shown which is normal to the discharge axis X. Alternatively, the pivoting movement can be about an axis parallel to the axis X where the blocking plate 70" is moved like a vane into and out of the blocking position, as shown schematically in FIG. 10A.

In FIG. 10, the pump handle 22 and piston 24 are shown in the end location after being moved in the discharge direction X2 in order to discharge water W form the pump chamber 26. In FIG. 12, the handle 22 and piston 24 are shown at the opposite location having fully moved in the charging direction X1 such that water W is drawn from the supply tank 14 into the pump chamber 26.

Figure 14:
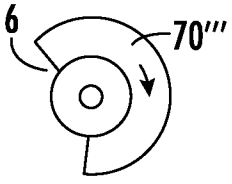
FIG. 14 is a view taken along line 14-14 in FIG. 13.
Figure 13:
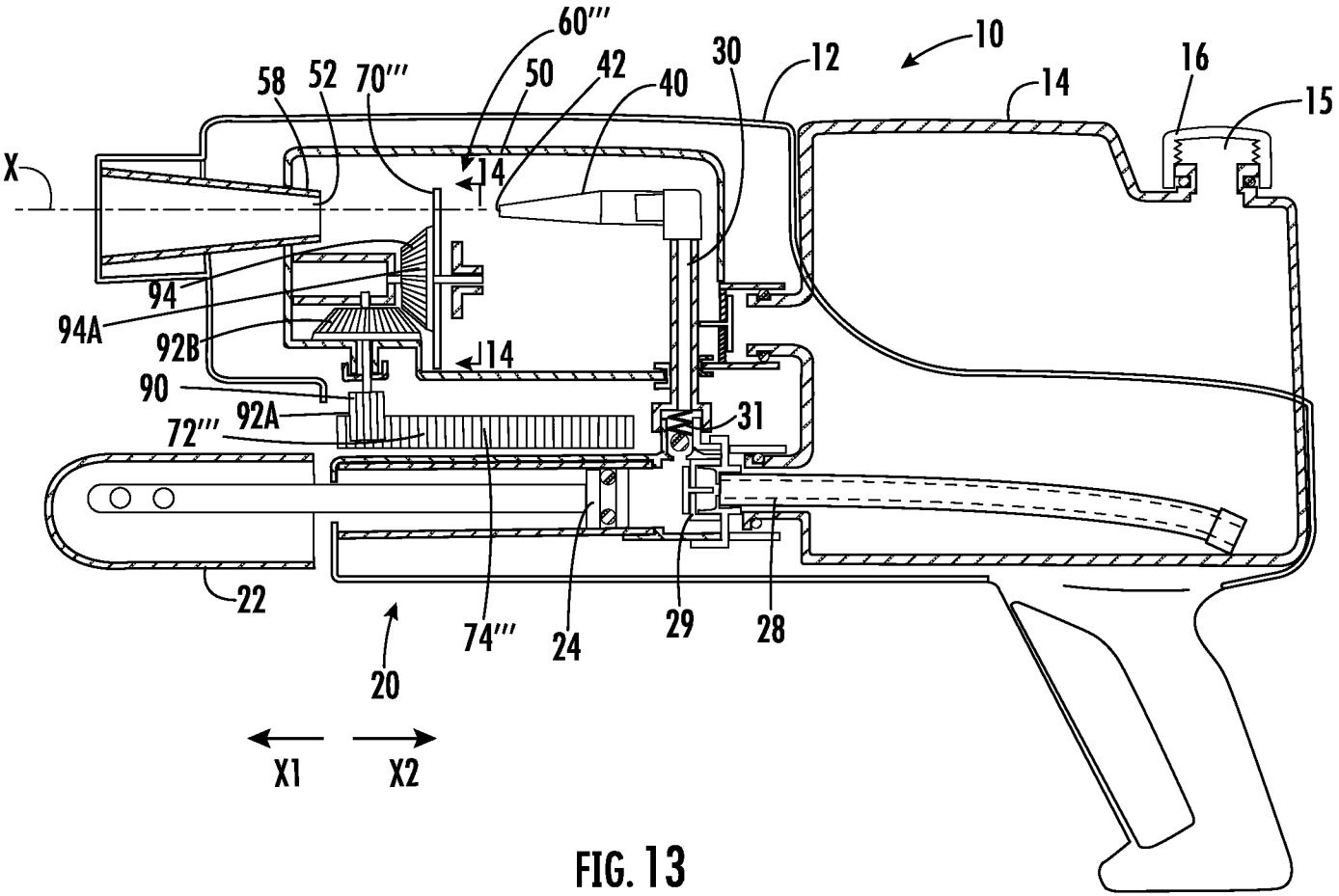
FIG. 13 is a left side view, partially in cross-section taken along line B-B in FIG. 3, showing the internal functional components of a fourth embodiment of a stream interrupter for the water gun shown in FIGS. 1-3.

Referring to FIGS. 13 and 14 a fourth embodiment of the water gun 10 is shown. The fourth embodiment is similar to the prior embodiments and like elements are identified with the same reference numerals. In the fourth embodiment, the toy water gun 10 includes the stream interrupter 60''' formed as a rotatable blocking plate 70''' that is mounted in the nozzle recovery chamber 50 between the nozzle opening 42 and the discharge opening 52 that is configured to periodically interrupt a flow of water W from the nozzle 40 along the discharge axis X to the discharge opening 52. The rotatable blocking plate 70''' is configured to rotate such that the discharge gap 66''', shown in FIG. 14, allows water to flow along the axis X when it is positioned there, but otherwise blocks the flow of water W, resulting in periodic bursts of the water W1, W2, W3 being delivered from the discharge opening 52.

In FIG. 13, the pump 20 that is a manually actuatable pump having a handle 22 connected to a piston 24 is used. Here, a gear rack 72''' having teeth 74''' is connected to the pump handle 22. A drive gear 90 is engaged with the gear rack 72''' via a first set of teeth 92A, and includes a second set of teeth 92B, shown as a bevel gear arrangement that engage with a second gear 94 having mating teeth 96A that engage with the second set of teeth 92B of the drive gear 90. Movement of the pump handle 22 in a charging direction X1 is adapted to draw water W from the supply tank 14 into a pump chamber 26, and movement of the pump handle 22 in an opposite, discharge direction X2 forces the water W to the nozzle 40. At the same time the rotatable blocking plate 70''' is rotated via movement of the 72''' so that the discharge gap 66''' allows periodic bursts of the water W1, W2, W3 to be delivered from the discharge opening 52. Any water that is blocked by the rotatable blocking plate''' is recovered in the nozzle recovery chamber 50 and recycled back to the tank 14.

Figure 15:
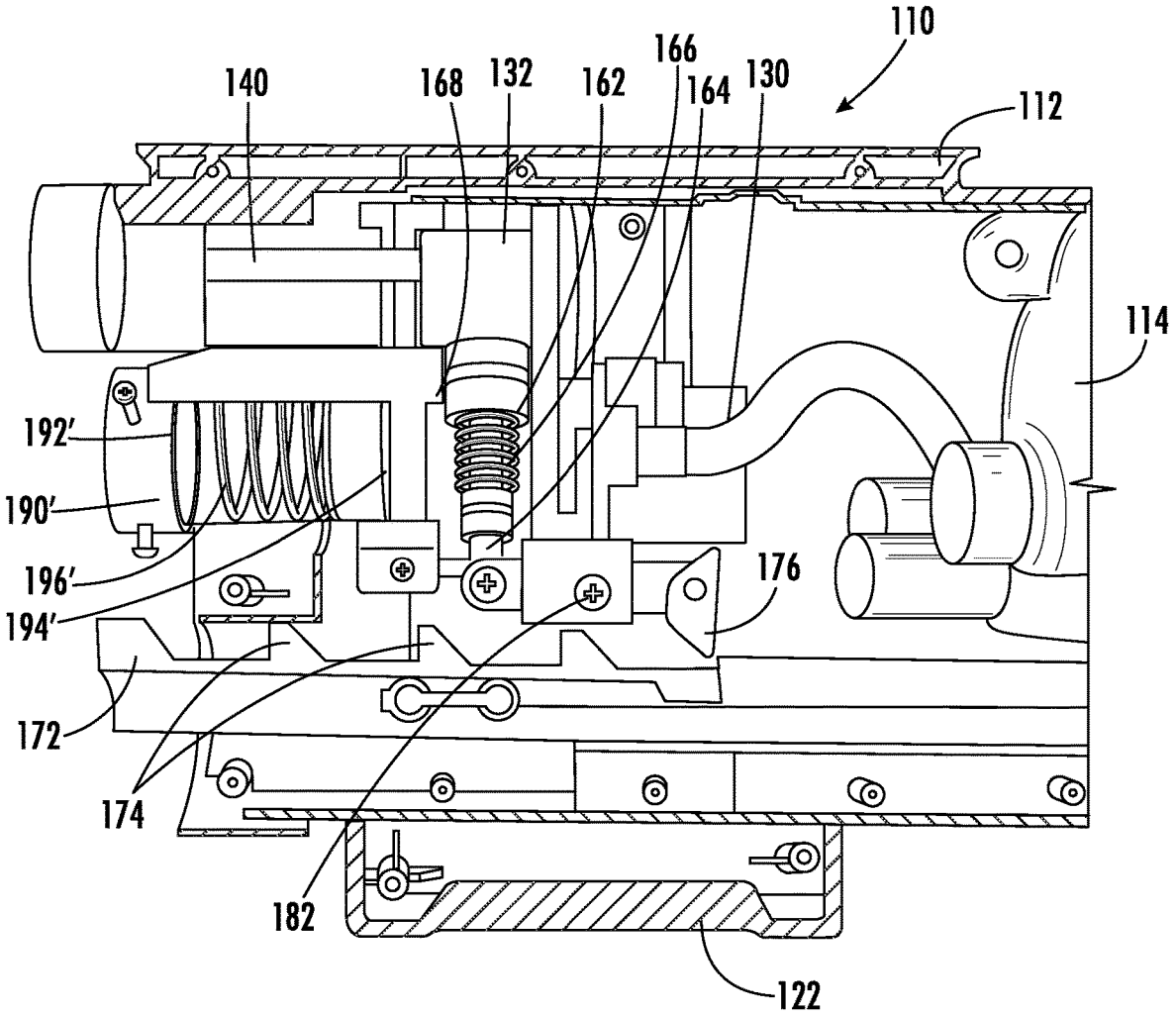
FIG. 15 is a left side view, partially in cross-section taken along line B-B in FIG. 3, showing the internal functional components of a fifth embodiment of the toy water gun shown in FIGS. 1-3.
Figure 16:
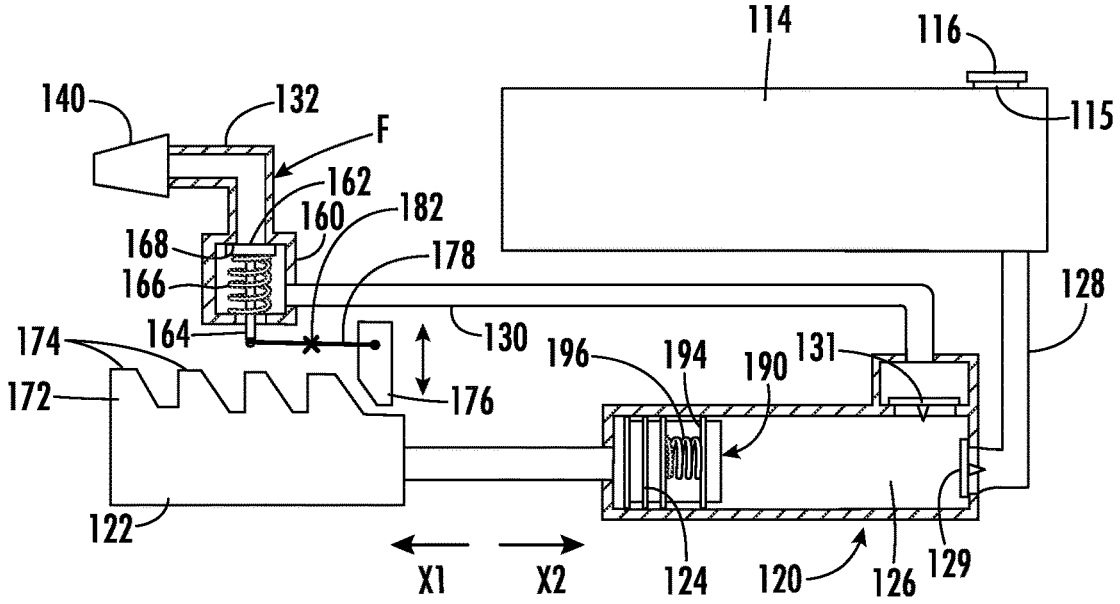
FIG. 16 is a functional diagram showing an alternate arrangement of the functional components of the water gun shown in FIG. 15 with the expansion tank formed as part of the pump piston/chamber.
Figure 17:
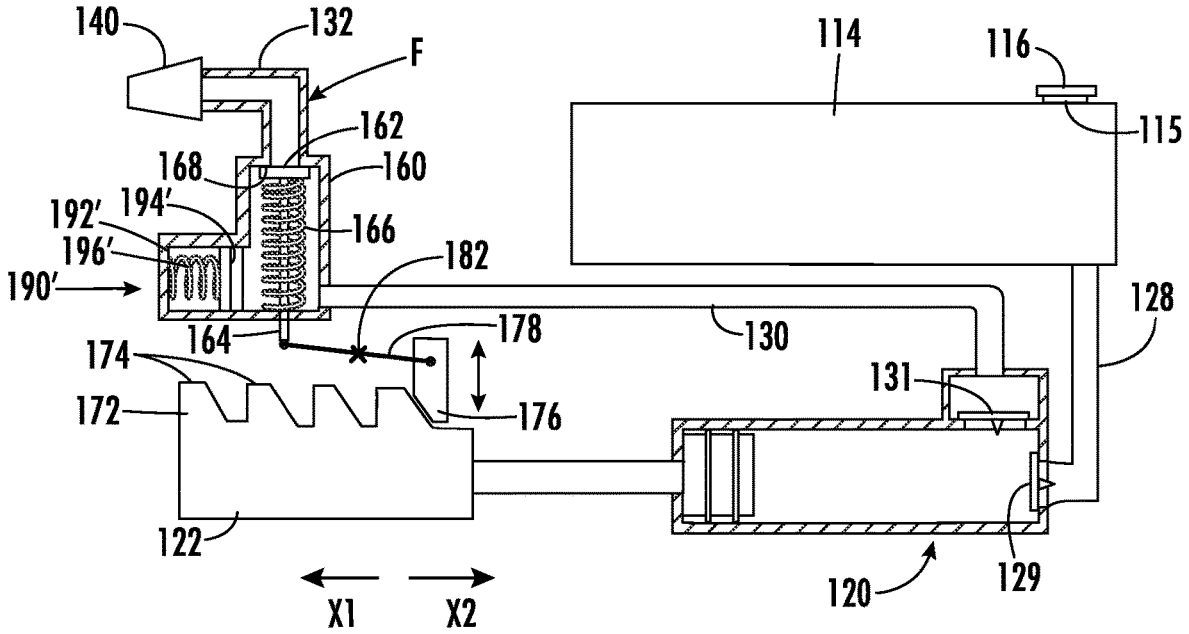
FIG. 17 is a functional diagram showing the arrangement of the functional components of the water gun shown in FIG. 15 with the expansion tank formed separately.

Referring to FIGS. 15-17, a fifth embodiment of a water gun 110 is shown. The water gun 110 includes the housing 112 as well as the supply tank 114 connected to the housing 112, with the supply tank 114 including a refill opening 115 as well as a cap 116. A pump 120 is provided for drawing water from the supply tank 114 and forcing the water to a nozzle 140. In a preferred arrangement, the pump 120 is a manually actuatable pump having a handle 122 connected to a piston 124, and movement of the pump handle 122 in a charging direction X1 is adapted to draw water W from the supply tank 114 into a pump chamber 126, and movement of the pump handle 122 in an opposite, discharge direction X2 forces the water W to the nozzle 140. As shown in FIG. 16, preferably a first tube 128 is connected between the supply tank 114 and the pump chamber 126, and a first check valve 129 is located in the first tube 128 or connection between the first tube 128 and the pump chamber 126.

An interrupter valve 160 is connected in a flow path F between the pump 120 and the nozzle 140 and is configured to periodically open and close as the pump 120 is actuated in order to interrupt the flow of water to the nozzle 140 such that periodic bursts of water W1, W2, W3 are adapted to be delivered from the nozzle 140. The flow path F preferably includes a second tube 130 connected between the pump chamber 126 and the interrupter valve 160 as well as a third tube 132 that extends from the interrupter valve 160 to the nozzle 140. A second check valve 131 is preferably located in the second tube 130 or at the connection between the second tube 130 and the pump chamber 126.

An expansion tank 190, 190' is provided in fluid communication with the flow path F between the pump 120 and the interrupter valve 160 and is configured to buffer a supply of pressurized water W from the pump 120 when the interrupter valve 160 is closed. The expansion tank 190 may comprises a moveable or flexible wall 194 located on the piston 124, as shown in FIG. 16. This can be a rigid wall 194 that is biased via a spring 196 from a front of the piston that forms an expansion tank 190 as part of the pump chamber 126, where the spring 196 is compressed when the interrupter valve 160 is closed such that the wall 194 moves toward the piston 124 in order to buffer a supply of pressurized water W from the pump 120. Alternatively, as shown in FIGS. 15 and 17, the expansion tank 190' may comprise a chamber 192' connected to the housing 112 with a moveable or flexible wall 194' located in the chamber 192'. In the illustrated embodiment, the wall 194' is rigid and a spring 196' is provided. Here, when the interrupter valve 160 is closed, water pressure causes the spring 196' to compress increasing a volume of the expansion tank 190 where the supply of pressurized water from the pump 120 is buffered.

Referring again to FIGS. 15-17, one preferred arrangement for activating the interrupter valve 160 is shown. Here a toothed rack 172 having teeth 174 is connected to the pump handle 122. A follower 176 is engaged with the toothed rack 172 and is configured to move up and down as the teeth 174 move past the follower 176. The follower 176 is connected to the interrupter valve 160 and is configured to periodically open and close the interrupter valve 160 as the pump handle 120 is moved in the discharge direction X2. In the exemplary embodiment, the interrupter valve 160 includes a valve body 162 that is connected to a valve stem 164. A spring 166 biases the valve body 162 into a closed position against a valve seat 168. A linkage 178, shown as being pivotable about a medial pivot point 182, is connected between the follower 176 and the valve stem 164, such that up and down movement 176 of the follower as the teeth 174 move past the follower 176 results in the valve body 162 being pulled away from the valve seat 168 periodically, opening and closing the valve in order to provide the periodic bursts of water W1, W2, W3 from the nozzle 140 that are discharged from the toy water gun 110.

Alternatively, it is possible to use a separate pump to pressurize the water tank and use a separate trigger to release the pressurized water from the tank toward the nozzle. Here, the toothed rack 172 can be connected to a separate handle similar to 122 that is movable as the trigger is engaged to activate the interrupter valve 160. Here, the interrupter valve 160 could be closed and then activated by the separate handle to discharge a rapid succession of spaced apart bursts of water W1, W2, W3, or set to an open position so that the toy water gun 110 fires an uninterrupted stream of water. Additionally, depending on the configuration of the pump used to pressurize the water tank, the expansion tank could be omitted.

Figures 18, 19:
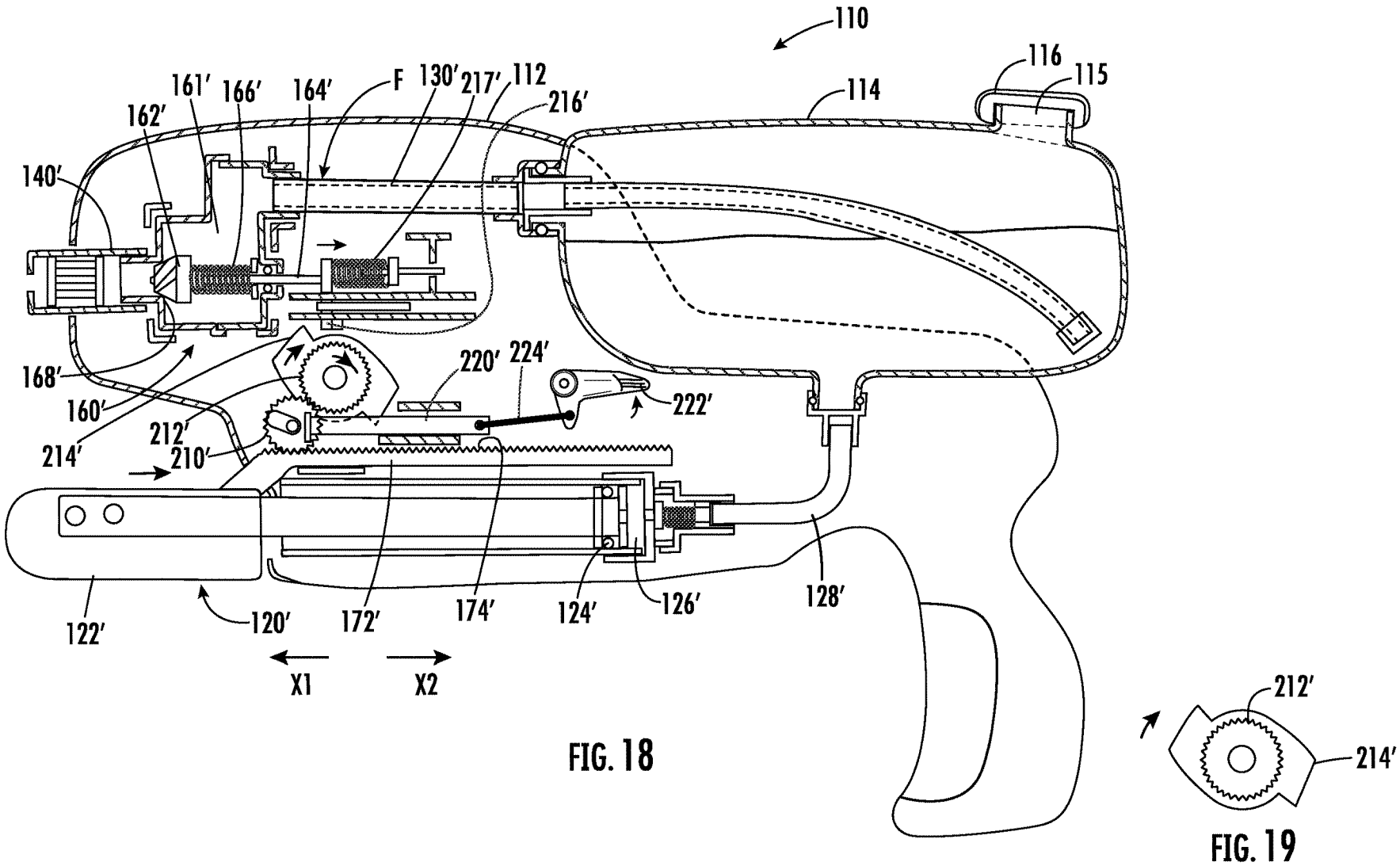
FIG. 18 is a left side view, partially in cross-section taken along line B-B in FIG. 3, showing the internal functional components of a sixth embodiment of a stream interrupter for the water gun shown in FIGS. 1-3.
FIG. 19 is a detail view of the cam in FIG. 18.

Referring now to FIGS. 18 and 19, a sixth embodiment of a water gun 110 is shown. The water gun 110 includes the housing 112 as well as the supply tank 114 connected to the housing 112, with the supply tank 114 including a refill opening 115 as well as a cap 116. In this case, the pump 120' is an air pump that is used to pressurize the supply tank 114, which can be filled with water via the refill opening 115, with air pressure. In a preferred arrangement, the pump 120' is a manually actuatable pump having a handle 122' connected to a piston 124', and movement of the pump handle 122' in a charging direction X1 is adapted to draw air into a pump chamber 126', and movement of the pump handle 122' in an opposite, discharge direction X2 forces the air into the tank 114 via a first tube 128'.

In this embodiment, an interrupter valve 160' is connected in a flow path F between the pump 120' and the nozzle 140' and is configured to periodically open and close as the pump 120' is actuated in the X2 direction in order to interrupt the flow of water to the nozzle 140' such that periodic bursts of water W1, W2, W3 are adapted to be delivered from the nozzle 140'. The flow path F preferably includes a second tube 130' connected between the supply tank 114 and the interrupter valve 160' located in a valve chamber 161'. The interrupter valve 160' includes a valve body 162' mounted on a stem 164' that is biased via a spring 166' to a closed position against the valve seat 168'

Still with reference to FIGS. 18 and 19, a mechanism for activating the interrupter valve 160' is shown. Here a gear rack 172' having teeth 174' is connected to the pump handle 122'. A first gear 210' is engaged with the gear rack 172' and is mounted for linear movement into and out of engagement with a second gear 212' that is connected to at least one cam 214'. The cam 214' is adapted to rotate and engage a slide block 216' that is linked with valve stem 164', either directly or via a snap-open spring 217', to open the valve body 162' of the interrupter valve 160'. Movement of the pump handle 122' in the pressurization direction X2 is configured to periodically open the interrupter valve 160' as the cam 214' pushes back the slide block 216' opening the valve body 162' until it eventually releases as the cam 214' passes under the engagement area of the slide block 216'. This discharges the periodic bursts of water W1, W2, W3 from the nozzle 140'. The spring 166' then biases the valve body 162' back to the closed position against the valve seat 168'.

The first gear 210' is mounted on a slide 220', and a return movement of the pump handle 122' in the X1 direction results in the gear rack 172' pulling the first gear 210' out of contact with the second gear 212'. Movement of the pump handle 122' in the X2 direction will make the interrupter valve 160' open and close rapidly. It will also pump air into the tank 114 at the same time. But making the valve 160' open and close will be its main duty at this stage. The gear ratio for the first and second gears 210', 212' can be set to make, for example, 3 to 5 times opening of the valve 160' for each full stroke movement of the pump handle 122'.

A lever switch 222' is shown and can be used to manually disengage the first gear 210' from the second gear 212' by acting via a link 224' on the slide 220' on which the first gear 210' is mounted to disengage it from the second gear 212'. This allows the pump 120' to be activated solely for pressurizing the tank 114 with air without discharging water from the water gun 110 since the valve 160' remains closed.

It is also possible to configure the lever switch 222' as a trigger. The water gun 110 can be set to the pulse shooting stage when the trigger is pressed, and at pressurizing stage when the trigger is not pressed.

A method of operating the toy water gun 10, 110 includes providing the water gun 10, 110, as discussed above, and a user placing water W in the supply tank 14, 114. The user actuates the pump 20, 120, for example by moving the handle 22, 122 in the discharge direction X2, and the stream interrupter 60 or the interrupter valve 160 periodically interrupts a flow of water such that periodic bursts of water W1, W2, W3, as shown in FIG. 2, are delivered from the discharge opening 52 or the nozzle 140 in rapid succession. In the first, second, and third embodiments of the water gun 10, the stream interrupter 60 interrupts the flow of water W from the nozzle 40 along the discharge axis X to the discharge opening 52 as the pump 20 is actuated. In the preferred embodiment, the pump 20 is the manually actuatable pump as discussed above. However, the pump could be a motor driven pump and activated by a trigger. Additionally, the stream interrupter 60', 60", 60''' can be manually actuated as discussed above via the toothed rack 72', 72" or gear rack 72''' connected to the pump handle 22 providing movement to a follower 76', 76" or a gear 90 that causes a blocking plate 70', 70" to periodically move into and out of a blocking position in order to periodically interrupt the flow of water from the nozzle 40 along the discharge axis X to the discharge opening 52. Alternatively, for the stream interrupter 60 formed as the helical vane 62 periodically blocks the flow of water from the nozzle 40 along the discharge axis X to the discharge opening 52, and the force of the stream of water W from the nozzle 40 itself rotates the helical vane 62 causing the periodic interruption of the flow of water from the nozzle 40 along the discharge axis X to the discharge opening 52.

In connection with the fifth and sixth embodiments of the toy water gun 110, the pressurized supply of water to the nozzle 140 is periodically interrupted by an interrupter valve 160.

In all embodiments, the pump 20, 120, 120' is ultimately used to provide pressurized water to the nozzle 40, 140, whether via direct displacement of water by the pump 20, 120 or by the pump 120' pressurizing the supply tank 114 with air, and the different pump types could be adapted to any of the embodiments. In each case, the pump 20, 120, 120' is configured to supply water under pressure to the nozzle 40, 140, even if the pump is used to pressurize a water supply.

In all embodiments, upon the user actuating the pump 20, 120, a flow of water to be discharged in a rapid succession of spaced apart bursts of water W1, W2, W3 that are clearly discernible.

Having thus described the presently preferred embodiments in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiments and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A water gun, comprising:

a housing;

a supply tank connected to the housing;

a pump configured to supply water from the supply tank under pressure to a nozzle;

a nozzle recovery chamber in which at least a nozzle opening of the nozzle is located or is directed so that water is directed through the nozzle recovery chamber along a discharge axis, and a discharge opening located in a wall of the nozzle recovery chamber, the discharge opening is aligned with the discharge axis so that the water is adapted to be discharged from the water gun along the discharge axis;

a stream interrupter located in the nozzle recovery chamber between the nozzle opening and the discharge opening that is configured to periodically interrupt a flow of water from the nozzle along the discharge axis to the discharge opening such that periodic bursts of water are adapted to be delivered from the discharge opening; and a check valve located in a fluid path between the nozzle recovery chamber and the supply tank.

2. The water gun of claim 1, further comprising the supply tank having a refill cap that seals a refill opening of the supply tank, and the pump drawing water from the supply tank is adapted to draw any water captured in the nozzle recovery chamber while the flow of water is interrupted back into the supply tank.

3. The water gun of claim 1, wherein the pump is a manually actuatable pump having a handle connected to a piston, and movement of the pump handle in a charging direction is adapted to draw water from the supply tank into a pump chamber, and movement of the pump handle in an opposite, discharge direction forces the water to the nozzle.

4. The water gun of claim 1, wherein the stream interrupter comprises a helical vane rotatably mounted on an axis parallel to the discharge axis such that a portion of the helical vane intersects the discharge axis, the helical vane including at least one discharge gap through which a portion of the flow of water from the nozzle along the discharge axis to the discharge opening can pass such that the periodic bursts of water are adapted to be delivered from the discharge opening.

5. The water gun of claim 4, wherein the helical vane is adapted to be rotated by the flow of water from the nozzle along the discharge axis to the discharge opening.

6. The water gun of claim 1, wherein the stream interrupter comprises a blocking plate that is mounted for pivoting or sliding movement and is configured to periodically move into a blocking position to block the flow of water from the nozzle along the discharge axis to the discharge opening to periodically interrupt the flow of water such that the periodic bursts of water are adapted to be delivered from the discharge opening.

7. The water gun of claim 6, wherein the pump is a manually actuatable pump having a handle connected to a piston, and movement of the pump handle in a charging direction is adapted to draw water from the supply tank into a pump chamber, and movement of the pump handle in an opposite, discharge direction forces the water to the nozzle, a toothed rack having teeth is connected to the pump handle, a follower is engaged with the toothed rack and is configured to move up and down as the teeth move past the follower, a linkage is connected between the follower and the blocking plate to pivot or slide the blocking plate into and out of the blocking position as the pump handle is moved in the discharge direction.

8. The water gun of claim 6, wherein the blocking plate is activated by activation of the pump.

9. The water gun of claim 1, further comprising a cone-shaped water baffle in the nozzle recovery chamber around the discharge opening.

10. A method of operating a water gun, comprising:

providing a water gun including a housing, a supply tank connected to the housing, a pump configured to supply water from the supply tank under pressure to a nozzle, a nozzle recovery chamber in which at least a nozzle opening of the nozzle is located that is directed to discharge water through the nozzle recovery chamber along a discharge axis, and a discharge opening located in a wall of the nozzle recovery chamber, the discharge opening is aligned with the discharge axis so that the water is adapted to be discharged along the discharge axis from the water gun, and a stream interrupter located in the nozzle recovery chamber between the nozzle opening and the discharge opening that is configured to periodically interrupt a flow of water from the nozzle along the discharge axis to the discharge opening, and a check valve located in a fluid path between the nozzle recovery chamber and the supply tank;

a user placing water in the supply tank;

the user actuating the pump, and the stream interrupter periodically interrupting a flow of water from the nozzle along the discharge axis to the discharge opening as the pump is actuated such that periodic bursts of water are delivered from the discharge opening.

11. The method of claim 10, wherein the pump is a manually actuatable pump having a handle connected to a piston, a toothed rack having teeth is connected to the pump handle, a follower is engaged with the toothed rack and is configured to move up and down as the teeth move past the follower, a linkage is connected between the follower and a blocking plate which forms the stream interrupter, and the method further comprises the user moving the pump handle in a charging direction to draw water from the supply tank into a pump chamber, and the user then moving the pump handle in an opposite, discharge direction forcing the water to the nozzle with the movement of the pump handle simultaneously causing the follower to move up and down as the teeth on the rack move past the follower, pivoting or sliding the blocking plate into and out of a blocking position to periodically interrupt a flow of water from the nozzle along the discharge axis to the discharge opening.

* * * * *